US008342077B1

(12) United States Patent
Stauss

(10) Patent No.: US 8,342,077 B1
(45) Date of Patent: Jan. 1, 2013

(54) BINARY CYLINDER ENGINE

(76) Inventor: Richard L. Stauss, Blanchester, OH (US)

( * ) Notice: Subject to any disclaimer, the term of this patent is extended or adjusted under 35 U.S.C. 154(b) by 818 days.

(21) Appl. No.: 12/462,627

(22) Filed: Aug. 6, 2009

Related U.S. Application Data

(60) Provisional application No. 61/188,052, filed on Aug. 7, 2008.

(51) Int. Cl.
*F01B 1/00* (2006.01)

(52) U.S. Cl. ..... 92/76; 92/140; 60/483

(58) Field of Classification Search ..... 92/140, 92/149, 147, 76, 68; 91/180, 181; 74/469; 60/483
See application file for complete search history.

(56) References Cited

U.S. PATENT DOCUMENTS 1,083,686 A * 1/1914 Kuhn ..... 92/72
1,174,522 A 3/1916 Roots
1,292,171 A 1/1919 Walk
1,458,922 A * 6/1923 Rivera ..... 91/345
1,965,548 A 7/1934 Hart
2,452,232 A 10/1948 Fischer
3,200,800 A 8/1965 DuBois
3,943,894 A 3/1976 Sumpter
4,094,227 A * 6/1978 King ..... 91/180
4,270,495 A 6/1981 Freudenstein et al.
4,532,819 A * 8/1985 Ross ..... 74/44
5,448,970 A 9/1995 Bray
5,870,978 A 2/1999 Willi et al.
6,058,901 A 5/2000 Lee
6,257,178 B1 7/2001 Laimbock
6,722,127 B2 4/2004 Scuderi et al.
7,270,092 B2 9/2007 Hefley

* cited by examiner

*Primary Examiner* — Edward Look
*Assistant Examiner* — Logan Kraft
(74) *Attorney, Agent, or Firm* — Charles R. Wilson

(57) ABSTRACT

A non-internal combustion reciprocating engine has an enhanced mechanical advantage lever system for efficiently converting linear motion from reciprocating pistons to rotary motion at a crankshaft. The engine comprises a chassis, at least two sets of binary cylinder systems mounted on the chassis, a crankshaft and a lever system. Each lever system has a piston lever, two thrust rods and a central drive lever. Each piston lever is pivotally attached to the chassis and pivotally attached to a piston rod extending from a piston cylinder. The two thrust rods are pivotally attached at one terminus to the piston lever and pivotally attached at a second terminus to the central drive lever. The two piston cylinders of each binary cylinder system work in concert to efficiently transfer power to the crankshaft.

19 Claims, 7 Drawing Sheets

BINARY CYLINDER ENGINE

This application claims the benefit of U.S. Provisional Application No. 61/188,052, filed Aug. 7, 2008.

FIELD OF THE INVENTION

This invention relates to an energy efficient engine. More particularly, the invention relates to a non-internal combustion engine with sets of binary cylinder systems.

BACKGROUND OF THE INVENTION

Reciprocating engines, often called piston engines, are well known and extensively used throughout the world. The main types of reciprocating engines are the internal combustion engine, the steam engine and the Stirling engine. In all three types, one or more cylinders with a reciprocating piston inside produces a linear motion which is transferred to a crankshaft to produce a rotary motion. The rotary motion is then used for a work task by way of various gears, etc. The most prevalent of the engines is a four stroke cycle internal combustion engine used to power motor vehicles.

While well known and commonly accepted, the common internal combustion engine needs to be improved upon to conserve dwindling energy sources and reduce emissions. Current designs are less than 20% efficient with over 60% of losses in wasted heat energy.

A reciprocating engine is needed which is more efficient in operation than the common internal combustion engines. A source of power to move pistons within cylinders of such engines which does not use internal combustion is needed. Still further, the ability to use a non-petroleum fuel such as a refrigerant and natural gas to power the engine is needed.

A non-internal combustion reciprocating engine as the sole source of powering a motor vehicle would be ideal, though given the power and speed demands of such vehicles may be difficult to achieve. Still, an auxiliary engine in the vehicle which can at the least drive a generator to meet the electrical power requirements of the vehicle would be a meaningful and beneficial advance.

SUMMARY OF THE INVENTION

A reciprocating engine of the invention is non-internal combustion pressure driven. The engine uses a lever system to achieve enhanced mechanical advantages in converting linear motion from pistons to rotary motion at a crankshaft. The engine includes a chassis, at least two sets of binary cylinders mounted on the chassis, and a crankshaft in operable association with the binary cylinders. Each cylinder in a binary cylinder set has a piston and a piston rod, wherein the piston rod is pivotally connected to a lever system. The lever system includes a piston lever, thrust rods and a central drive lever. The piston lever is pivotally attached to the chassis while the two thrust rods are pivotally attached to the piston lever and to the central drive lever. The central drive lever for each set of binary cylinders is rotatably mounted on a crankshaft throw. The lever system effectively transfers power to the crankshaft.

DETAILED DESCRIPTION OF THE INVENTION

The engine of the invention comprises a chassis having at least two set of binary pistons linked to a crankshaft. The pistons are pressure driven e.g. by compressed air, heat expansion from a working fluid, or any other known means. The engine is a feasible alternative to conventional gasoline engines used in home and commercial applications. It can as well be used in the auto industry. For example, it can be used as the auto's sole source of power. Alternatively, the engine can be used in a hybrid auto to run the auto's generator while a gasoline engine supplies the main source of power.

Figure 1:
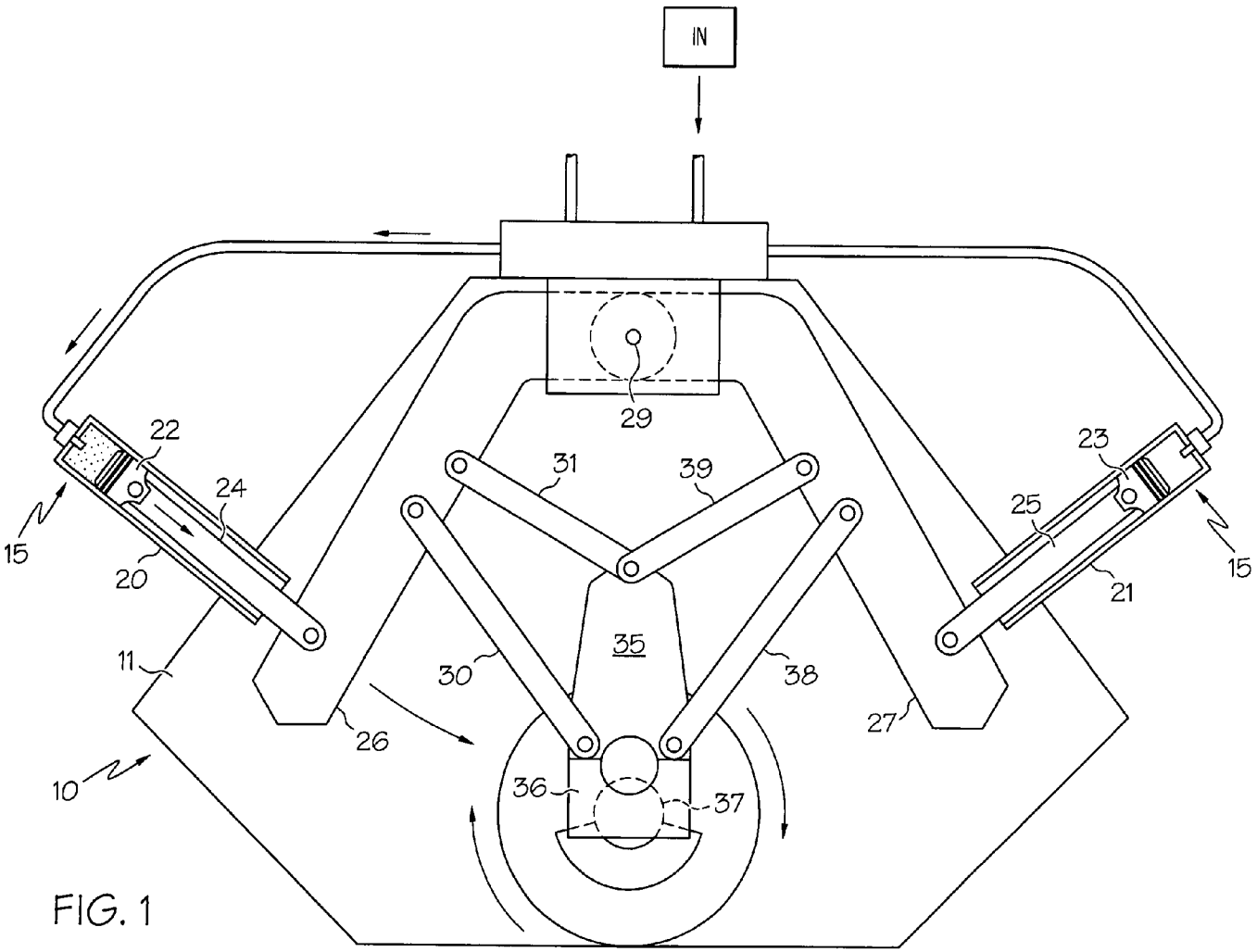
FIG. 1 is a schematic illustration of a pressure driven reciprocating engine of the invention showing the beginning of a power stroke in a first cylinder.

With reference to FIG. 1, there is shown the engine 10 of this invention mounted on a chassis 11. The chassis 11 is a frame for supporting the engine 10 and can take many forms. The chassis 11 can be a set of structural steel braces secured together in a configuration to support the engine's components. It can as well be an engine block with pistons mounted therein.

The essential components of the engine 10 include at least two binary cylinder systems. Linear movement from pistons within piston cylinders in the binary cylinder systems is converted to a rotary movement at a crankshaft by a lever system to gain a mechanical advantage. Thus, a piston rod extending from each piston is attached to a piston lever. Thrust rods extend from the piston lever to a central drive lever. The central drive lever is mounted on a throw of the crankshaft. A flywheel on the crankshaft is not required, but is preferred for smoother rotation and reduced pulsation. The binary cylinder systems and their interaction with the other essential components of the engine are described in more detail in the following paragraphs and with reference to FIGS. 1-5.

Figure 6:
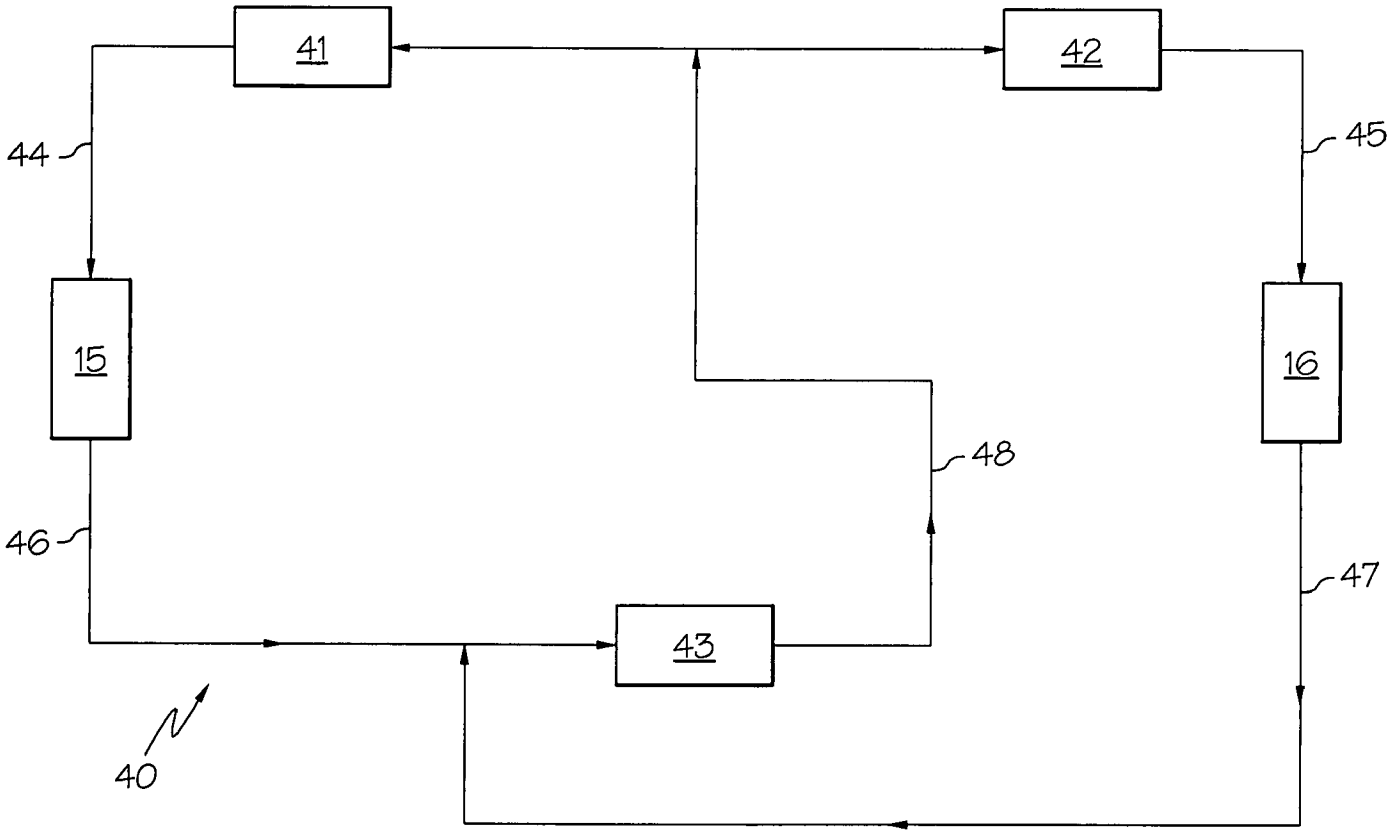
FIG. 6 is a block diagram showing a closed system for delivering pressure to the engine of the invention.

For ease of illustration and clarity, FIG. 1 shows one binary cylinder system set. A second binary cylinder system set (not depicted) is directly behind the first set. More binary cylinder systems can be used depending on the power needs of the engine. Two sets of binary cylinder systems are the minimum. From two to six sets of binary cylinder systems are feasible and preferred. Three sets of binary cylinder systems, as shown in FIG. 6, are ideal for efficiency of operation. Each of the binary cylinder system sets are identical in structure and operation.

A first binary cylinder system set 15 of the engine 10 is comprised of a first piston cylinder 20 and a second piston cylinder 21. Pistons 22 and 23 within the cylinders 20 and 21, respectively, have operatively associated piston rods 24 and 25. The rods 24 and 25 are mounted on their associated pistons to travel linearly along an extended center axis of the cylinders 20 and 21. When piston 22 is fully extended as on an expansion stroke, piston 23 is fully retracted as on a contraction stroke. Piston rod 24 is pivotally attached at its distal end to piston lever 26 near a lower end while piston rod 25 is pivotally attached at its distal end to piston lever 27, also near a lower end. Moving the position of the piston cylinders down on the chassis so that their associated piston rods are pivotally mounted lower on the piston levers will result in more torque. Conversely, moving the position of the piston cylinders upwardly so that their associated piston rods are pivotally mounted higher on the piston levers results in more engine rpms and consequent speed. Upper ends of the piston levers are pivotally attached at a common point 29 to the chassis. The common point 29 is located at the top central vertical axis, directly over a center axis of the crankshaft. The piston lever 26 has two thrust rods 30 and 31 pivotally attached at first ends in mid-portions thereof and pivotally attached at opposed second ends to the central drive lever 35. The precise mid-points of attachment are important, but can be determined by routine experimentation. Similarly, the piston lever 27 has two thrust rods 38 and 39 pivotally attached to it and to the central drive lever 35. The two thrust rods 38 and 39 are attached to its piston lever 27 at the same points as the opposing thrust rods 30 and 31 are attached to its piston lever 26. Central drive lever 35 itself is pivotally attached to a throw 36 of the crankshaft 37.

When a piston is driven downward in its cylinder during an expansion cycle, its associated piston rod forces the piston lever, its two thrust rods and central drive lever to transfer the linear motion of the piston rod into rotational motion of the crankshaft. Pistons 22 and 23 are working in concert so that as piston 22 is driving its piston rod 24 outwardly, piston 23 is retracting its piston rod 25 inwardly. The two pistons are properly valved to work in concert. Sequential timing of the binary cylinder systems, while important, is routinely accomplished. A sequential timing of the piston cylinders 20 and 21 operation dictates that each of the piston levers has an overlapping parameter. They, in effect, work in tandem.

A second binary cylinder system 16 present in the engine 10 (but not shown in FIG. 1) is properly valved to work with the first binary cylinder system. In effect, each set of thrust rods propels an engine stroke. Each set of binary cylinders in a system is engaged in an alternating stroke pattern. There is no compression stroke, thereby providing a continuous operational advantage.

It should be understood, FIG. 1 does not illustrate all elements of an engine. For example, valves and bearings at pivot connections are not shown. Such components are well known as understood by one skilled in engines.

Figure 2:
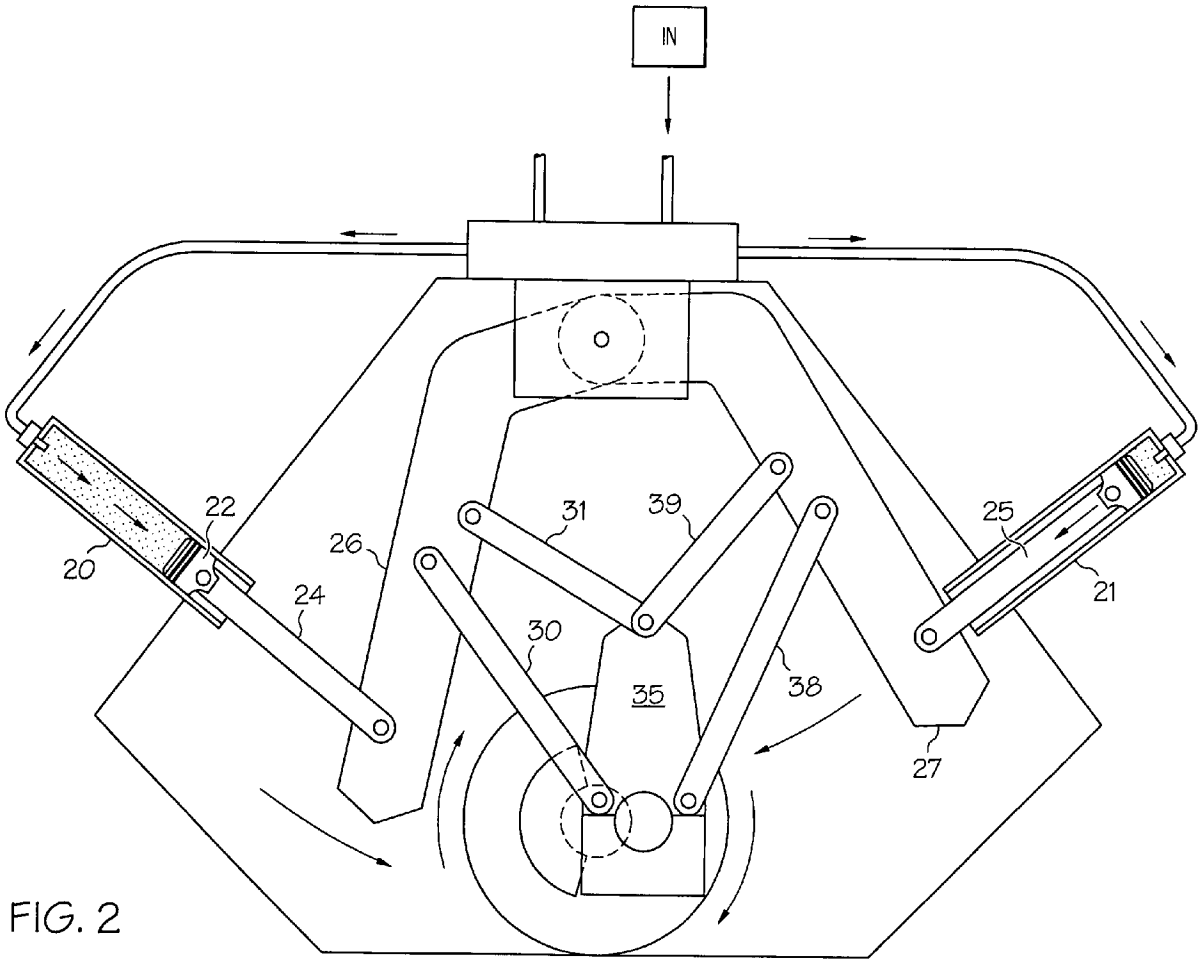
FIG. 2 is a schematic illustration of the engine of FIG. 1 wherein a piston rod of the first cylinder is fully extended to rotate a crankshaft throw one quarter turn and a power stroke of a second cylinder is beginning.
Figure 3:
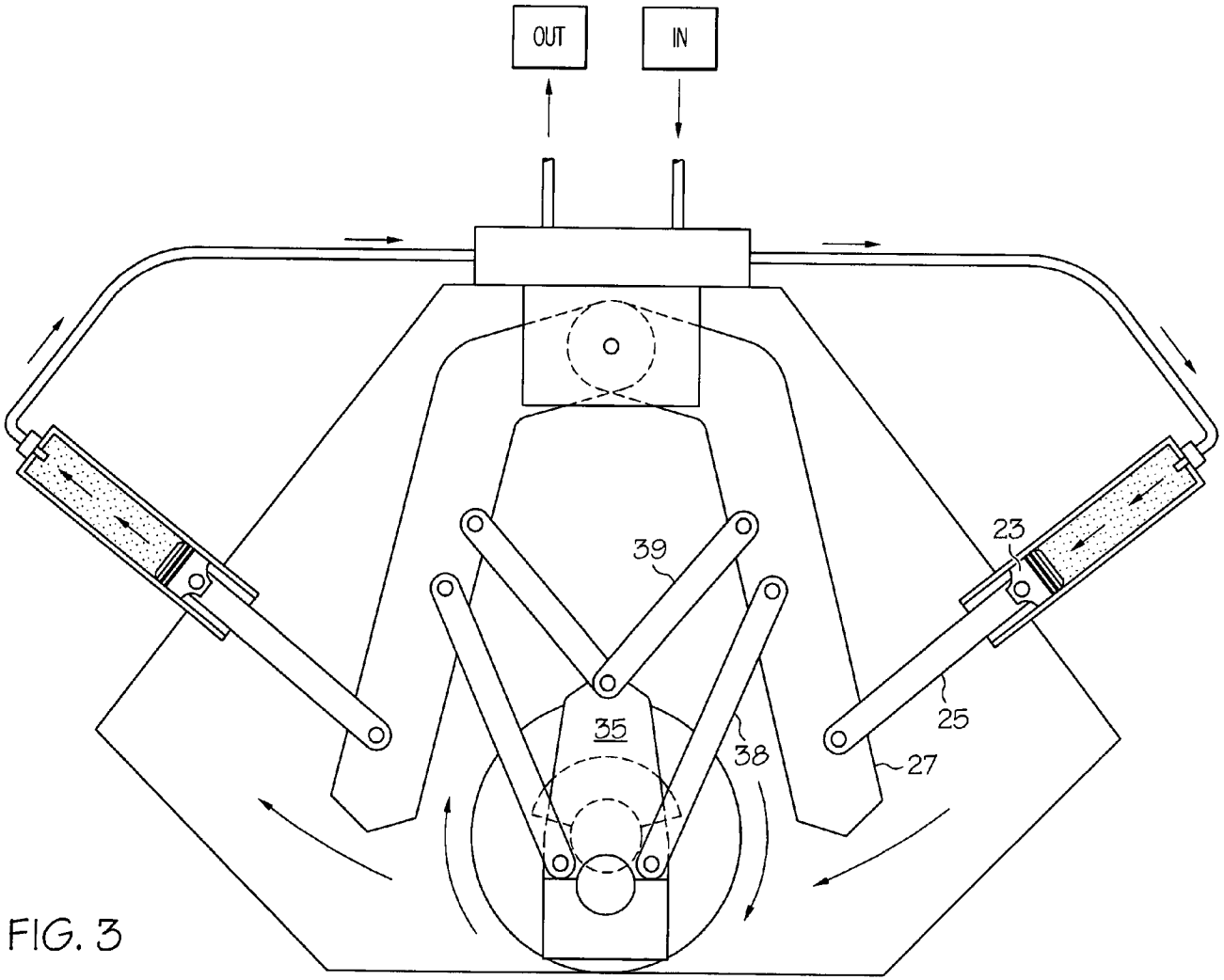
FIG. 3 is a schematic illustration of the engine of FIG. 2 wherein the piston in the first cylinder is being forced back upwardly in its cylinder and a piston in the second cylinder is being forced down to deliver a force to an associated piston lever.
Figure 4:
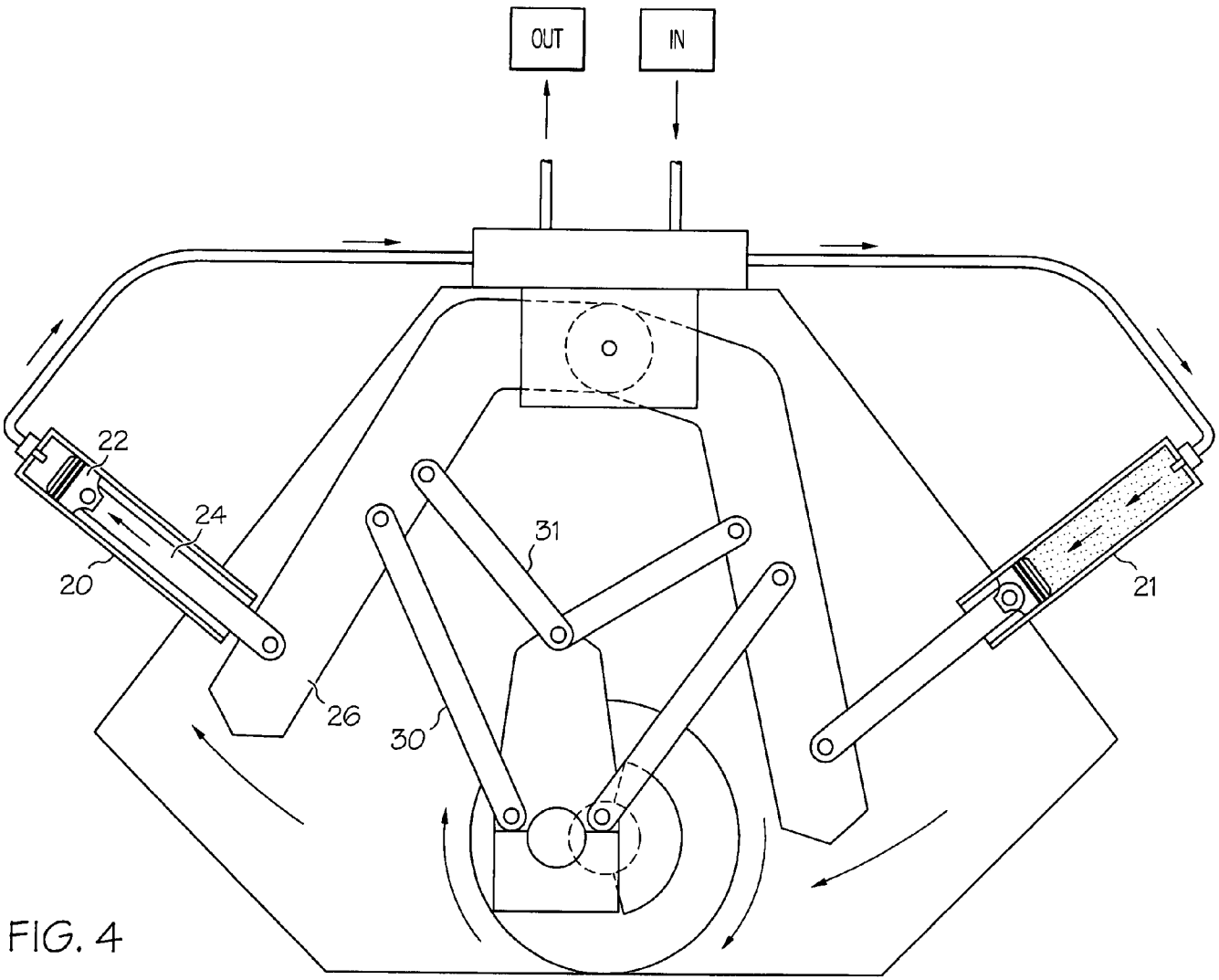
FIG. 4 is a schematic illustration of the engine of FIG. 3 wherein the piston of the first cylinder is fully withdrawn into the cylinder and the piston rod of the second cylinder is fully extended at the bottom of the piston's stroke.
Figure 5:
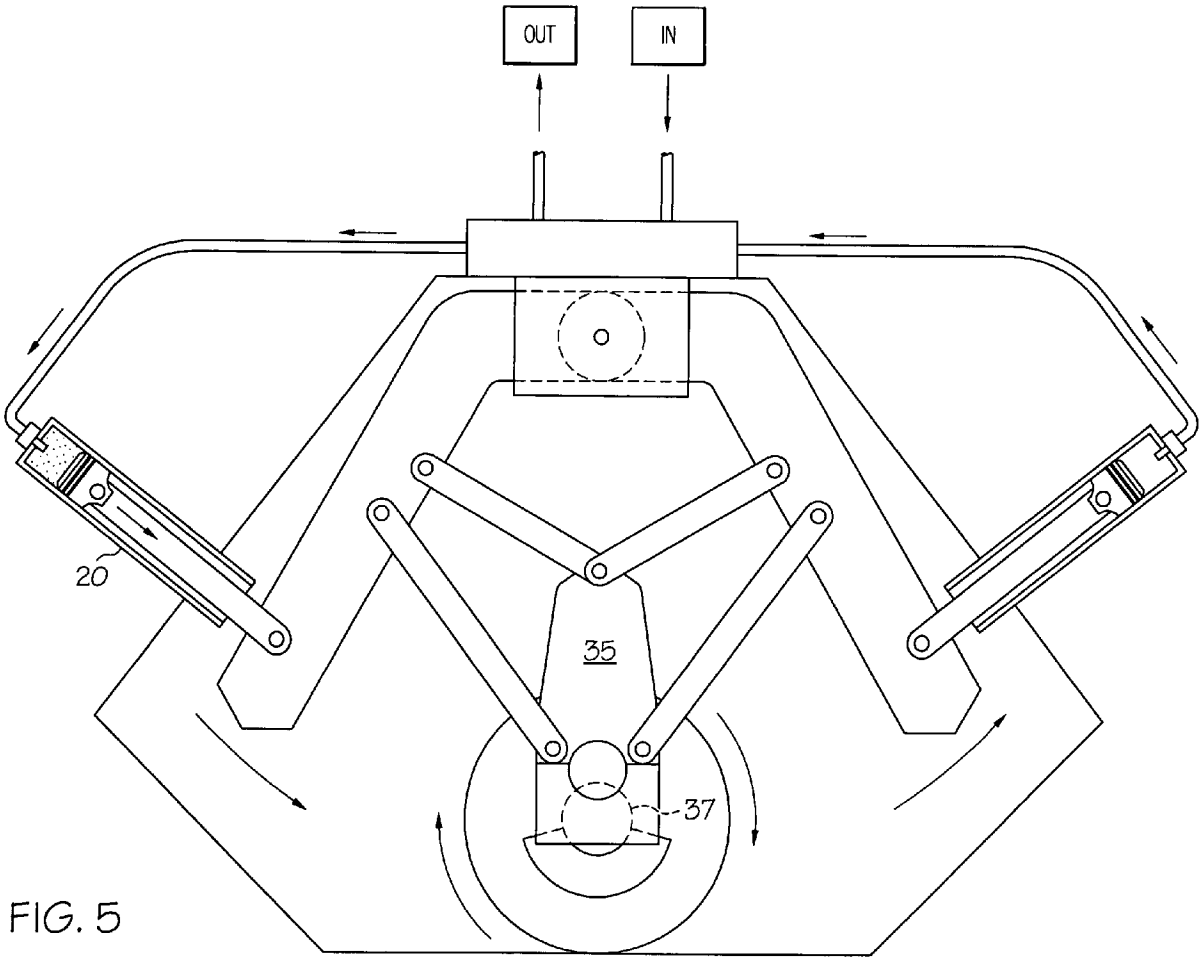
FIG. 5 is a schematic illustration of the engine of FIG. 4 wherein the pistons of the first and second cylinders have returned to the positions shown in FIG. 1 and are ready to repeat the cycle.

Now with reference to FIGS. 1-5, operation of the engine of this invention is shown. In FIG. 1, compressed air begins to enter cylinder 20 forcing down piston 22 and its associated piston rod 24. Piston rod 24 travels in a linear path along the cylinder 20's longitudinal centerline axis. This forces down piston lever 26 in the direction of the arrow. The linear motion of the piston rod and piston lever is transferred through the thrust rods 30 and 31. In turn, the central drive lever 35 rotates in a clockwise direction to begin to turn the crankshaft throw. In FIG. 2, a full charge of compressed air has caused the piston 22 to be at the end of the cylinder and its piston rod 24 fully extended. The crankcase throw has revolved one-quarter turn. Action of the thrust rods 38 and 39 has forced piston lever 27 upwardly and its associated piston rod 25 fully into its cylinder 21. Compressed air is now forced into cylinder 21 as seen in FIG. 3 to cause its piston 23 and piston rod 25 to transfer power to the associated piston lever 27, thrust rods 38 and 39, and central drive lever 35. When a full charge of compressed air is in the cylinder 21, the crankshaft throw has rotated another quarter turn so that it is now top dead center. In FIG. 4, the full charge of compressed air in piston cylinder 21 and consequent movement of the crankshaft throw results in still another quarter turn of the crankshaft and the forcing, through operation of thrust rods 30 and 31 and piston lever 26, the full retraction of piston rod 24 and piston 22 into their associated cylinder 20. Finally, with reference to FIG. 5, compressed air is reintroduce to cylinder 20 to bring the central drive lever 35 back to top dead center and one complete revolution of the crankshaft 37. The cycle is repeated to effect a steady output of rotary motion from the crankshaft 37.

The engine of FIG. 1 is powered by compressed air, thereby showing its viability. Other power sources are feasible. A hermetically sealed system using a working fluid which is repeatedly heated and cooled in the piston cylinders to drive the pistons is ideal. The working fluid can be air, though a refrigerant is preferred. A fuel such as natural gas is used to heat the working fluid. Heat from the natural gas can be supplanted by solar energy. The efficiencies of the engine of this invention are such that a variety of means for generating pressure can be utilized.

A practical manner to provide the pressure needed to run the engine of this invention is depicted in block form in FIG. 6. A pressure system 40 uses a set of boilers 41 and 42, a condenser 43, and closed lines charged with a refrigerant. Again with reference to the engine 10 described above, the boiler 41 is used to supply pressurized gas to the cylinders of the first binary cylinder system 15, and the second boiler 42 is used to supply pressurized gas to the cylinders of the second binary cylinder system 16. Each boiler has a coil running through it with refrigerant. A burner associated with each boiler, fueled by natural gas, heats the coil to cause the refrigerant to vaporize and discharge at a high pressure into lines 44 and 45, respectively. These lines in turn lead to the first binary cylinder system 15 and second binary cylinder system 16. Lines 46 and 47 carry the refrigerant, still in vapor form, to the condenser 43. The condenser 43 has coil tubing running through it where heat is dissipated by air cooling. A fan or some other cooling source such as water cooling can be used if needed. The cooled refrigerant now in liquid form passes through a line 48 back to the boilers 41 and 42 to repeat the cycle. Reclaimed heat energy from the condenser 43 can be used to pre-heat the refrigerant prior to entering the boilers 41 and 42.

Figure 7:
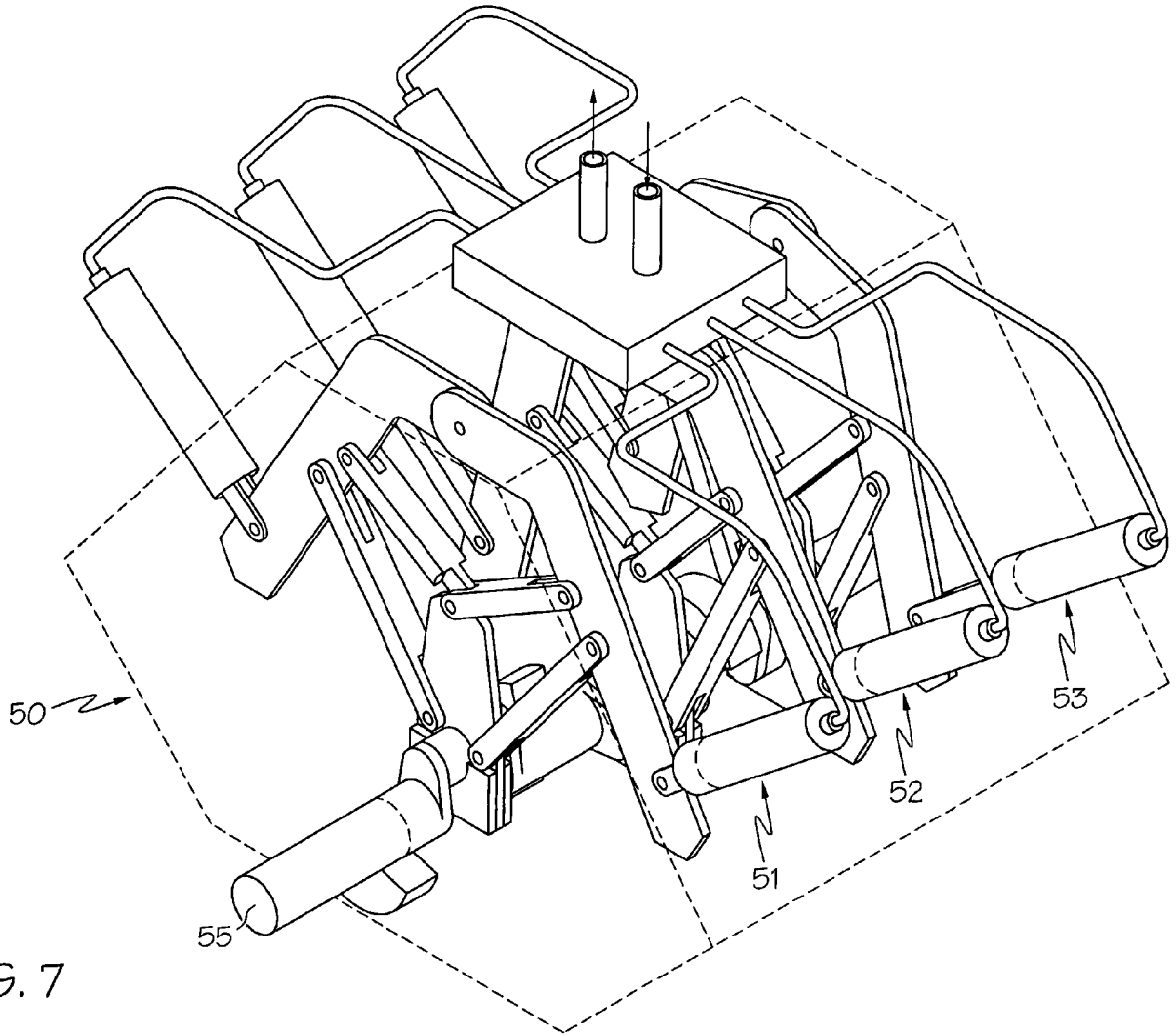
FIG. 7 is a view in perspective of an engine of the invention having three sets of binary cylinders.

FIG. 7 shows an engine 50 of the invention based on three sets of binary cylinder systems. The binary cylinder system 51, 52 and 53 have the same components as binary cylinder system 15 of engine 10 described above with reference to FIGS. 1-5. The cylinders of each binary cylinder system work in concert. The three binary cylinder systems further are properly valved to work in concert to provide a smooth continuous output of rotary motion at the crankshaft 55.

The above described engines achieve their objectives by the use of mechanical advantages through the lever systems. It is a very effective in converting heat to mechanical energy. Thrust exerted against pistons of the engine is maximized, thereby allowing a smaller volume of the piston cylinders to produce an equal or greater output than previously experienced.

The engine of the invention is relatively quiet in operation. A high torque output is achieved per energy expended. There is a balanced operation resulting in low vibrations. In addition, natural gas used in the preferred mode is abundant. The engine is a sealed system with only minimal make-up working fluid needed.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A pressure driven reciprocating engine with an enhanced mechanical advantage lever system for the efficient conversion of linear motion from pistons of the engine to rotary motion at a crankshaft, said engine comprising:

(a) a chassis;

(b) at least two sets of binary cylinder systems mounted on the chassis, each cylinder of one said set of binary cylinder systems having a reciprocating piston mounted therewithin with a piston rod extending outwardly from the reciprocating piston;

(c) a crankshaft in operable association with the chassis, said crankshaft having a throw for receiving a force from each reciprocating piston of each said set of said binary cylinder systems;

(d) a piston lever for each cylinder of each said set of binary cylinder systems, each said piston lever pivotally mounted on the chassis and pivotally attached to the piston rod of each said cylinder;

(e) two thrust rods pivotally attached to each of said piston levers;

(f) a central drive lever operably associated with each set of binary cylinder systems and rotatably mounted on a throw of the crankshaft and further each of the two thrust rods on each piston lever is pivotally attached to the central drive lever for transferring power to said crankshaft, whereby each set of binary cylinder systems work in concert to convert linear motion from the piston rods of each cylinder of the set of binary cylinder systems to rotary motion at the crankshaft.

2. The pressure driven reciprocating engine of claim 1 having from two to six sets of binary cylinder systems.

3. The pressure driven reciprocating engine of claim 2 having two sets of binary cylinder systems.

4. The pressure driven reciprocating engine of claim 1 wherein said engine is a non-internal combustion engine.

5. The pressure driven reciprocating engine of claim 1 wherein pressure is supplied by compressed air.

6. The pressure driven reciprocating engine of claim 1 wherein a closed system containing a working fluid is used to deliver pressure to each cylinder of each set of binary cylinder systems.

7. The pressure driven reciprocating engine of claim 1 wherein each piston lever is pivotally attached at a first terminus to the chassis and a piston rod pivotally attached thereto near a second terminus.

8. The pressure driven reciprocating engine of claim 7 wherein the two thrust rods associated with each of the piston levers is pivotally attached in mid-points of said piston levers.

9. The pressure driven reciprocating engine of claim 8 wherein one of said two thrust rods is pivotally attached to an upper first terminus of the central drive lever and the other of said two thrust rods is pivotally attached to a lower second terminus of the central drive lever.

10. The pressure driven reciprocating engine of claim 1 wherein the piston levers of each set of binary cylinder systems are pivotally attached to the chassis at a common point.

11. The pressure driven reciprocating engine of claim 1 wherein the chassis is an engine block.

12. A pressure driven reciprocating engine with an enhanced mechanical advantage lever system for the efficient conversion of linear motion from pistons of the engine to rotary motion at a crankshaft, said engine comprising:

(a) a chassis;

(b) from two to six sets of binary cylinder systems mounted on the chassis, each cylinder of one said set of binary cylinder systems having a reciprocating piston mounted therewithin with a piston rod extending outwardly from the reciprocating piston and attached to the piston to move linearly along the centerline axis of the cylinder;

(c) a crankshaft in operable association with the chassis, said crankshaft having from two to six throws for receiving a force from each reciprocating piston of each said set of said binary cylinder systems;

(d) a piston lever for each cylinder of each said set of binary cylinder systems, each said piston lever pivotally mounted on the chassis at a common point with an opposed piston lever and pivotally attached to the piston rod of each said cylinder;

(e) two thrust rods pivotally attached to each of said piston levers at a mid-section thereof;

(f) from two to six central drive levers, each of said central drive levers operably associated with each set of binary cylinder systems and each of said central drive levers rotatably mounted on a throw of the crankshaft and further each of the two thrust rods on each piston lever is pivotally attached to the central drive lever for transferring power to said crankshaft, whereby each set of binary cylinder systems work in concert to convert linear motion from the piston rods of each cylinder of the set of binary cylinder systems to rotary motion at the crankshaft.

13. The pressure driven reciprocating engine of claim 12 wherein said engine is a non-internal combustion engine.

14. The pressure driven reciprocating engine of claim 12 wherein pressure is supplied from a closed system containing a refrigerant.

15. The pressure driven reciprocating engine of claim 14 wherein natural gas is used to vaporize the refrigerant to deliver pressure to each cylinder of each set of binary cylinder systems.

16. The pressure driven reciprocating engine of claim 1 wherein each piston lever is pivotally attached at a first terminus to the chassis and a piston rod pivotally attached thereto near a second terminus.

17. The pressure driven reciprocating engine of claim 16 wherein one of said two thrust rods is pivotally attached to an upper first terminus of the central drive lever and the other of said two thrust rods is pivotally attached to a lower second terminus of the central drive lever.

18. The pressure driven reciprocating engine of claim 1 wherein the chassis is an engine block.

19. A non-internal combustion pressure driven reciprocating engine with an enhanced mechanical advantage lever system for the efficient conversion of linear motion from pistons the engine to rotary motion at a crankshaft, said engine comprising:

(a) an engine block;

(b) three sets of binary cylinder systems mounted in the engine block, each cylinder of one said three sets of binary cylinder systems having a reciprocating piston mounted therewithin with a piston rod extending outwardly from the reciprocating piston along a centerline of the cylinder;

(c) a crankshaft in operable association with the engine block, said crankshaft having three throws for independently receiving a force from the reciprocating pistons of each said set of said binary cylinder systems;

(d) a piston lever for each cylinder of each said set of binary cylinder systems, each said piston lever pivotally mounted on the engine block and pivotally attached to the piston rod of each said cylinder;

(e) two thrust rods pivotally attached to each of said piston levers;

(f) a central drive lever operably associated with each set of binary cylinder systems and rotatably mounted on a throw of the crankshaft and further each of the two thrust rods on each piston lever is pivotally attached to the central drive lever for transferring power to said crankshaft, whereby each set of binary cylinder systems work in concert to convert linear motion from the piston rods of each cylinder of the set of binary cylinder systems to rotary motion at the crankshaft.

* * * * *